United States Patent [19]

Jaschkowitz

[11] 4,200,223

[45] Apr. 29, 1980

[54] CENTRIFUGE ROTOR

[76] Inventor: Herbert Jaschkowitz, Ettlensegart 71, 7200 Tuttlingen, Fed. Rep. of Germany

[21] Appl. No.: 956,030

[22] Filed: Oct. 30, 1978

[30] Foreign Application Priority Data

Nov. 30, 1978 [DE] Fed. Rep. of Germany ..... 2753265

[51] Int. Cl.[2] ..... B04B 5/02

[52] U.S. Cl. ..... 233/26

[58] Field of Search ..... 233/26, 11, 1 R

[56] References Cited

U.S. PATENT DOCUMENTS 3,666,171 5/1972 Filz ..... 233/26

*Primary Examiner*—George H. Krizmanich

*Attorney, Agent, or Firm*—Charles E. Baxley

[57] ABSTRACT

A rotor structure for a centrifuge is shown in which a pair of U-shaped arms each are provided with respective pairs of legs. One leg on each of the arms is clamped between a base part and a counter plate. The other legs on adjacent pairs of arms permit a ring that carries a test tube assembly to pivot in response to centrifuge rotor motion.

4 Claims, 4 Drawing Figures

CENTRIFUGE ROTOR

TECHNICAL FIELD

The invention relates to centrifuges and, more particularly, to centrifuges that have holding means for several test tubes distributed around the respective rotor peripheries, and the like.

BACKGROUND ART

Centrifuge rotor balancing hitherto has required a great deal of special attention. Thus, the invention is therefore directed to the need to provide a centrifuge rotor that is simple to build and after manufacture, no longer needs to be balanced.

Accordingly, it is an object of the present invention to provide an improved centrifuge rotor. It is a further object of the invention to provide a centrifuge rotor that is simple to build and does not need to be balanced after manufacture is completed.

SUMMARY OF THE INVENTION

These and other problems are overcome, to a large extent, through the practice of the invention. One illustrative embodiment of the invention is characterized, for example, in that each of the rotor holding means consists of a pair of U-shaped arms. One of the legs on each of these arms is engaged in a receiver on the hub of the rotor. These legs are held by a common counter plate which extends radially over the leg and presses the arms onto the rotor hub.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

BRIEF DESCRIPTION OF THE DRAWING

The invention will be described with reference to the accompanying drawings showing embodiments thereof.

DETAILED DESCRIPTION

Figure 2:
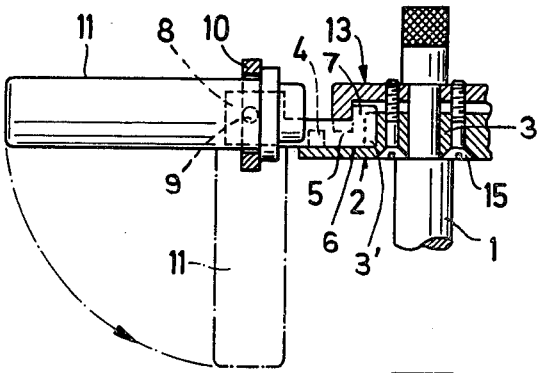
FIG. 2 is a front view of a portion of the rotor shown in FIG. 1, in partial section along the line A—A of FIG. 1.
Figure 1:
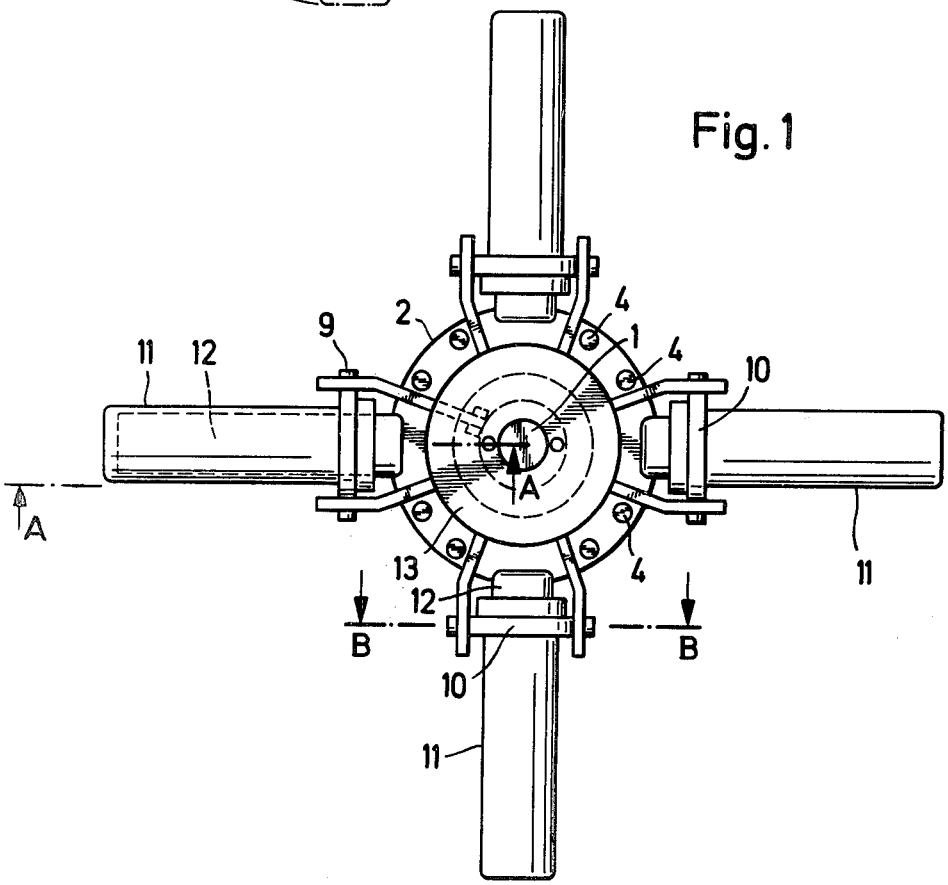
FIG. 1 shows a plan view of rotor with four test tubes mounted thereon.

In the rotor shown there is fixed on a spindle 1 a disc-like base part 2 (see FIG. 2). This base part forms the hub of the rotor and has for this purpose a rotatable and symmetrical collar which extends in an axial direction. On the upper side and near the periphery of this base part, legs 4 (FIGS. 1 and 2) protrude upwardly. These legs 4, moreover, are fixed at uniform angular distances from each other.

Figure 3:
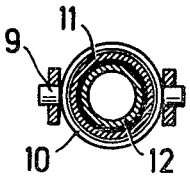
FIG. 3 is a full section taken along the line B—B of FIG. 1.

U-shaped profiled arms 5 (FIG. 2) lie with their respective bases 6 on the upper side of the disc-shaped base part 2. The arms as shown in the FIG. 1 plan view are bent through angles to enable portions of the arms 5 which extend beyond the circumference of the base part 2 to be generally parallel. That is to say that the arms lay substantially in radial directions with respect to the motor spindle 1. As shown, the arms 5 extend outwardly from the periphery of the base part 2. The arms are bent respectively in pairs towards one another. As illustrated in the front elevation in FIG. 2, the arms 5 each have a shorter leg 7 and a longer leg. The shorter leg 7 lies on the collar 3 of the base part 2 within narrow slits 3' which engage a part of the shorter leg. The longer leg 8 has a bore 9 to permit a ring 10 (FIGS. 2 and 3) to be carried between each pair of the arms 5. Each ring 10 is pivotable in the two bores 9 of arms 5 as indicated in FIG. 2. In each of these rings 10 a beaker 11 is inserted to receive a test tube 12 (FIG. 3).

A counter plate 13 is placed from above in order to bear down upon the arms 5. As illustrated, the counter plate has a matching, although inverted U-shape when viewed in section as shown of FIG. 2. The short legs 7 of the arms 5 are thus held in place by means of the counter plate 13. The base part 2 and the counter plate 13 are connected to one another and pressed together in order to retain the arms 5 in position by screws 15.

Figure 4:
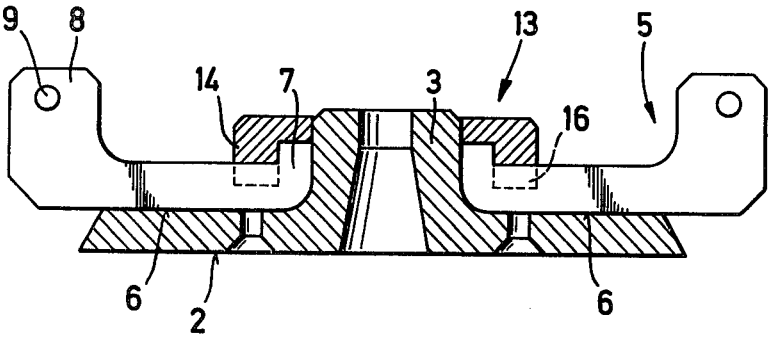
FIG. 4 is a view in full section of another embodiment of a base plate according to the invention.

Another structural embodiment of the base part 2 and counter plate 13 is shown in FIG. 4. As illustrated, slits 16 which engage the arms 5 are not formed in the collar 3, but are formed in a downwardly protruding flange 14 on the counter plate 13. The counter plate 13 also has a centrally disposed bore which engages the periphery of the hub 3. Within the hub 3, the passageway for receiving the motor spindle 1 is, in part, a frustrum of a cone.

Further in accordance with a feature of the invention that is shown in FIG. 4, the arms 5 are snugly engaged within the recess that is formed between the base part 2 and the counter plate 13.

The counter plate presses the arms 5 onto the hub and holds the arms in a horizontal position. This part 13 is made for the most part of metal but may also be made of plastics. Note in this instance, with respect to the embodiment that is shown in FIG. 4 that countersunk bores for screws that join the counter plate 13 to the base part 2 are not in the hub 3, but are in alignment with the flange 14.

The base part 2 consists preferably of plastic. This base part 2 may be designed for receiving two or four (as shown) or six, eight, twelve, sixteen etc. beakers 11 with test tubes.

I claim:

1. A rotor for a swinging test tube centrifuge, the centrifuge comprising a disc-like base plate and an axially oriented collar on said base plate forming the hub of the centrifuge rotor, a plurality of pairs of U-shaped arms, the bases of said arms resting upon the base plate and one of each of said arms' upturned members bearing against said collar, a counter plate concentric with said base plate engaging said upturned members of said arms that bear against said collar, and a protruding flange on said collar extending into the bight of each of said U-shaped arms in order to hold said upturned members of said arms against said collar.

2. A rotor according to claim 1 wherein said axially oriented collar is rotationally symmetric and forms with said disc-like base plate a rotor hub.

3. A rotor according to claim 2 further comprising a plurality of pins protruding axially from said disc-like base plate in order to radially space said U-shaped arms.

4. A rotor according to claim 1 wherein said protruding flange further comprises an array of open slots formed in said flange, each of said slots receiving a portion of a respective one of said U-shaped arms.

* * * * *